US012751567B2

(12) United States Patent
Mintz

(10) Patent No.: US 12,751,567 B2
(45) Date of Patent: Oct. 6, 2026

(54) OVER THE DOOR HANGING ASSEMBLY

(71) Applicant: Columbia Frame Inc., Montreal (CA)

(72) Inventor: Stirling Mintz, Montreal (CA)

(73) Assignee: Columbia Frame Inc., Montreal (CA)

( * ) Notice: Subject to any disclaimer, the term of this patent is extended or adjusted under 35 U.S.C. 154(b) by 0 days.

(21) Appl. No.: 18/679,536

(22) Filed: May 31, 2024

(65) Prior Publication Data

US 2025/0366637 A1 Dec. 4, 2025

(51) Int. Cl.
*A47G 1/16* (2006.01)

(52) U.S. Cl.
CPC ..... *A47G 1/1653* (2013.01)

(58) Field of Classification Search
CPC ..... A47G 1/1653; A47G 1/16
USPC .... 248/306, 475.1, 470, 489, 490, 497, 466, 248/476, 477, 690, 691, 692, 302, 303, 248/304, 322, 339, 340, 341; 40/757, 40/759, 617
See application file for complete search history.

(56) References Cited

U.S. PATENT DOCUMENTS 1,530,407 A * 3/1925 Ranson ..... A47B 61/003 211/100
1,778,255 A * 10/1930 Frost ..... A47B 61/003 248/295.11
2,645,357 A * 7/1953 Taylor ..... A47G 25/18 211/117
2,735,597 A * 2/1956 Treleven ..... B60R 7/082 206/5
3,512,621 A * 5/1970 Teetor ..... A45C 3/004 206/287
4,301,956 A * 11/1981 Hoerner ..... B60R 9/10 224/311
5,337,905 A * 8/1994 Gast ..... A47B 61/02 211/85.3
5,624,071 A * 4/1997 Sosan ..... A47G 29/20 232/29
5,644,806 A * 7/1997 Mariol ..... A47D 13/063 5/99.1
5,678,880 A * 10/1997 Keller ..... B60J 3/0208 296/97.11
9,386,867 B2 * 7/2016 Kressin ..... F16B 45/00
D801,703 S * 11/2017 Robertson ..... D6/300
D884,363 S * 5/2020 Narzikul ..... D6/300
11,350,716 B2 * 6/2022 Beeler ..... A45C 11/00
11,849,870 B1 * 12/2023 Gong ..... A47G 1/24
(Continued)

*Primary Examiner* — Kimberly T Wood
(74) *Attorney, Agent, or Firm* — David L. Nocilly; Bond Schoeneck & King PLLC

(57) ABSTRACT

An over the door hanging apparatus formed from a pair of hangers and a corresponding set of brackets that allows each hanger to be extended or retracted from the object to be positioned on the door. Each hanger includes a shaft extending from a ball to a hook and each mounting bracket includes a channel having a passageway dimensioned to accept the shaft but not the ball of each hanger. The shaft of each of the pair of hangers extends through the passageway the mounting brackets so that each of the pair of hangers is moveable between a retracted position, where the ball is not engaged with the channel, and an extended position, where the ball is engaged with the channel. The hangers are thus free to extend and retract from the object, and also free to rotate about a longitudinal axis of the shaft of the hooks.

8 Claims, 6 Drawing Sheets

(56) References Cited

U.S. PATENT DOCUMENTS

| | | | | |
|---|---|---|---|---|
| 2002/0092957 | A1* | 7/2002 | Martorelli | B44D 3/12 248/205.3 |
| 2006/0120090 | A1* | 6/2006 | Wikle | F21V 21/406 362/651 |
| 2006/0137949 | A1* | 6/2006 | Levinson | A45C 5/14 190/110 |
| 2006/0219851 | A1* | 10/2006 | Stewart, III | B25H 3/006 248/200 |
| 2011/0024586 | A1* | 2/2011 | Brinkdopke | A47K 10/421 248/323 |
| 2011/0248060 | A1* | 10/2011 | Luk | B60R 11/02 224/567 |
| 2014/0014803 | A1* | 1/2014 | Kressin | F16M 13/02 248/490 |
| 2014/0374305 | A1* | 12/2014 | Fimbrez | A45C 9/00 206/581 |

* cited by examiner

OVER THE DOOR HANGING ASSEMBLY

BACKGROUND OF THE INVENTION

1. Field

The present disclosure relates to hanging system for objects and, more specifically, to a retractable over the door hanger assembly.

2. Description of the Related Art

Over the door hanging systems are used for attaching an object, such as a mirror, to one side of a door. Standard over the door hanging system use a pair of hangers that can be connected to mounting brackets positioned on the rear of the mirror. These systems require the use of complex mounting brackets and require the user to attach the hangers to the mounting brackets on the rear of the mirror. Accordingly, there is a need in the art for an over the door hanging system that is easy to deploy and fully assembled for the user.

BRIEF SUMMARY OF THE INVENTION

The present invention provides an over the door hanging apparatus that can be deployed for use simply by extending hangers from a retracted position and then hooked over the top of a door. The over the door hanging apparatus comprises a pair of hangers, wherein each hanger includes a shaft extending from a ball to a hook. The over the door hanging apparatus further comprises a set of mounting brackets, wherein each bracket includes a channel having a passageway dimensioned to accept the shaft but not the ball of each hanger. The shaft of each of the pair of hangers may extend through the passageway of at least one bracket of the set of mounting brackets so that each of the pair of hangers is moveable between a retracted position, where the ball is not engaged with the channel, and an extended position, where the ball is engaged with the channel. The set of mounting brackets may include two mounting brackets associated with each of the pair of hangers. The mounting brackets are secured to an object. The object may have two opposing lateral sides and the mounting brackets are secured to opposing lateral sides of the object. The hooks of each of the hangers may be positioned below an upper edge of the object when the hooks are in the retracted position. The hooks of each of the hangers may be spaced apart from the upper edge of the object when the hooks are in the extended position. The hangers may be free to rotate about a longitudinal axis of the shaft of the hooks.

The present invention also includes a method of suspending an object from a door. The method includes the step of providing an over the door hanging apparatus having a pair of hangers, wherein each hanger includes a shaft extending from a ball to a hook, and a set of mounting brackets, wherein each bracket includes a channel having a passageway dimensioned to accept the shaft but not the ball of each hanger. The method further includes the step of coupling the over the door hanging apparatus to the object by securing the set of mounting brackets to a side of the object with the shafts of the hangers extending through the channels of the mounting brackets. The method also includes the step of positioning the hooks over a top of the door. Each of the pair of hangers is moveable between a retracted position, where the hooks positioned proximately to object, and an extended position, where hooks are extended from the object. The set of mounting brackets includes two mounting brackets associated with each of the pair of hangers. The mounting brackets may be secured to the object by screws. The object may have two opposing lateral sides and the mounting brackets are secured to opposing lateral sides of the object. The hooks of each of the hangers may be positioned below an upper edge of the object when the hooks are in the retracted position. The ball of each of the hangers may be in connect with one channel of one mounting bracket when the hangers are in the extended position. The hangers may be free to rotate about a longitudinal axis of the shaft of the hooks.

BRIEF DESCRIPTION OF THE SEVERAL VIEWS OF THE DRAWING(S)

The present invention will be more fully understood and appreciated by reading the following Detailed Description in conjunction with the accompanying drawings, in which.

DETAILED DESCRIPTION OF THE INVENTION

Figure 1:
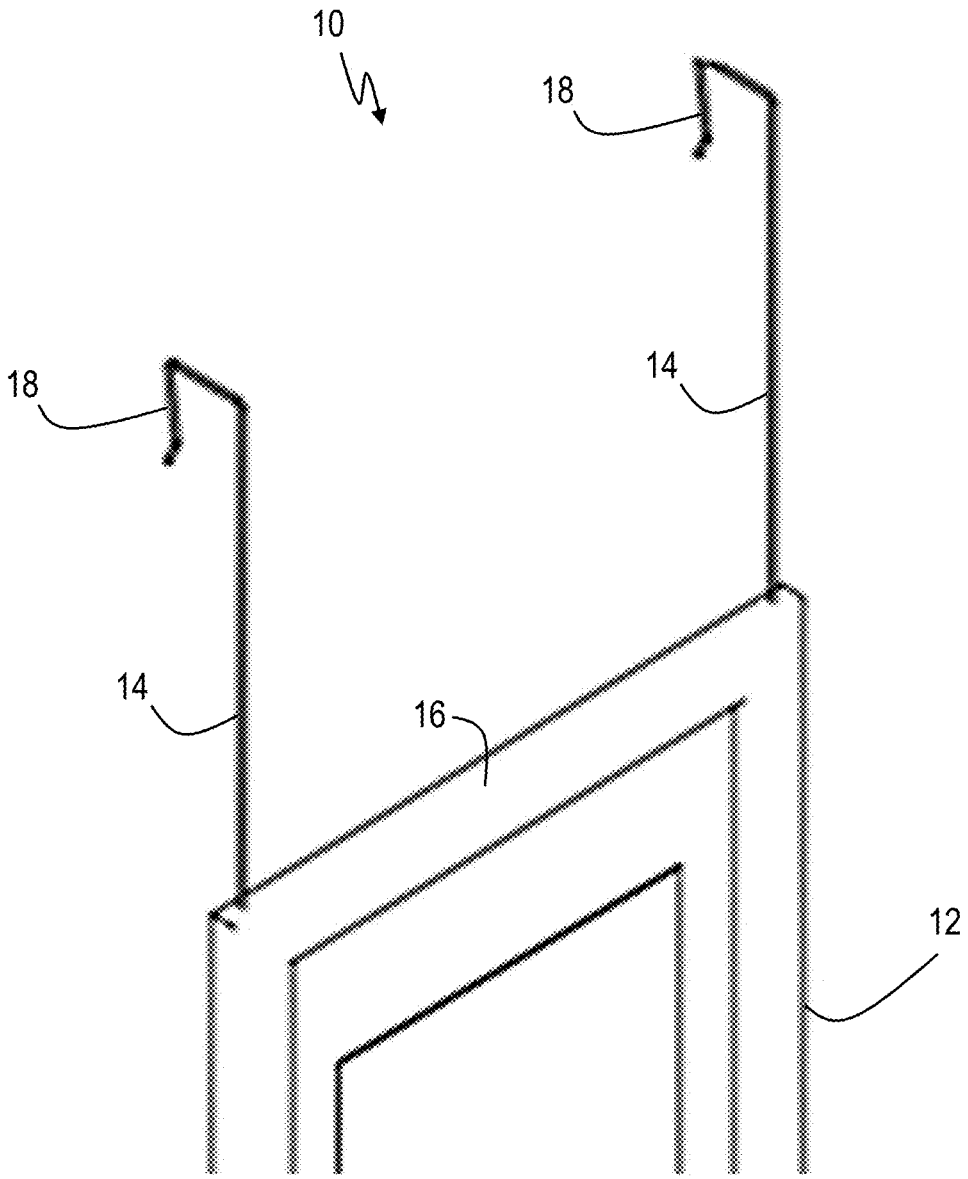
FIG. 1 is a schematic of a mirror that includes an over the door hanging assembly according to the present invention.

Referring to the figures, wherein like numerals refer to like parts throughout, there is seen in FIG. 1, an over the door hanging assembly 10 coupled to an object 12 to be suspended from the upper edge of a door. Over the door hanging assembly 10 includes a pair of hangers 14 that extend from the upper edge 16 of the object 12. Each hanger 14 includes a hook 18 that is dimensioned to be secured over the top of a door without interfering with operation of the door.

Figure 2:
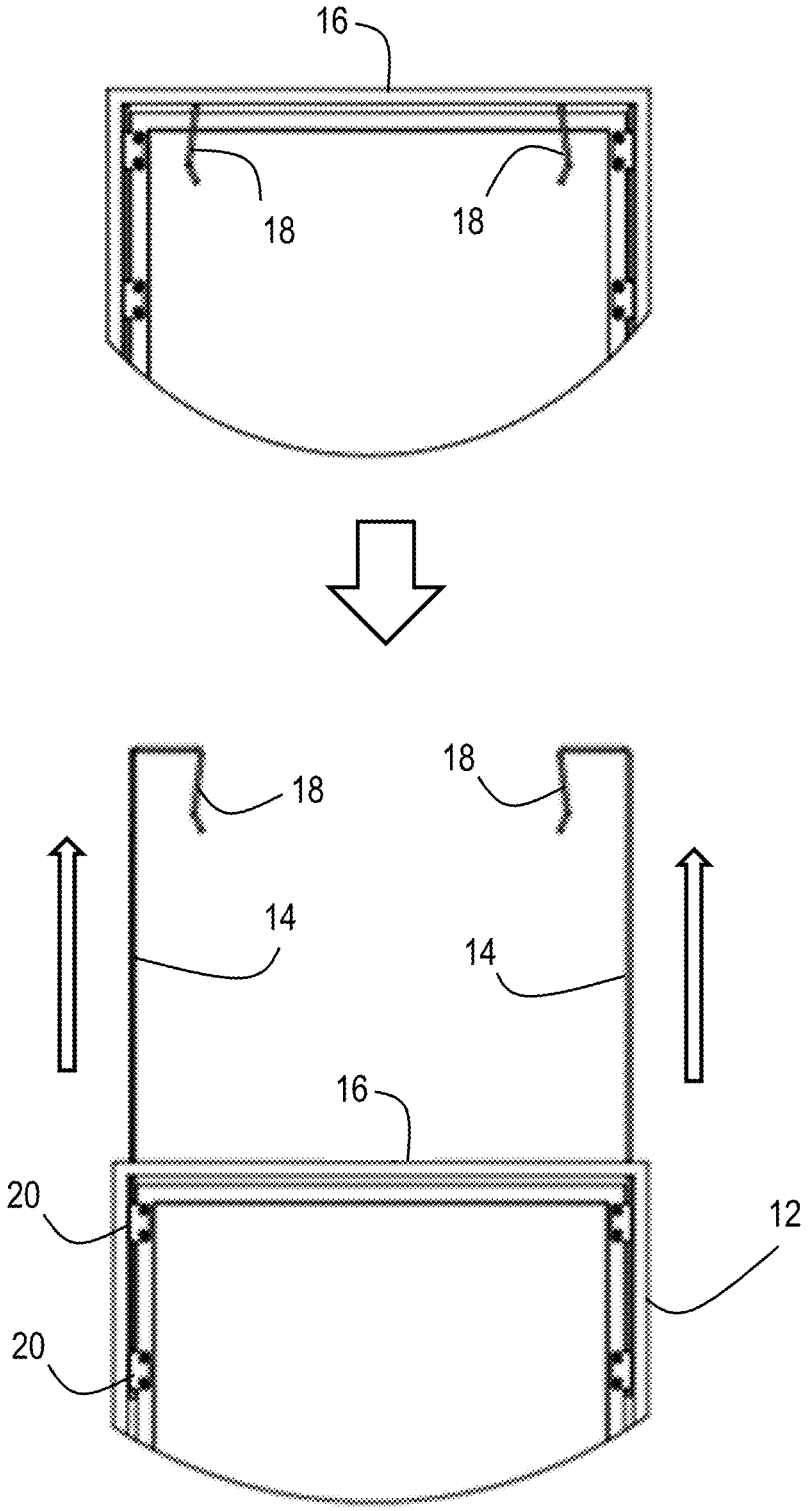
FIG. 2 is a schematic showing an over the door hanging assembly according to the present invention with the hangers in a retracted position and in an extended position.

Referring to FIG. 2, each hanger 14 may be moved between a retracted position, where hooks 14 may be pivoted into flush engagement with the rear surface of object 12, and an extended position, where hooks 14 are spaced apart from upper edge 16 of object 12 and pivotal into an orientation where hooks 14 can engage the upper edge of a standard door. Hooks 14 are coupled to the rear surface of object 12 by a pair of mounting brackets 20.

Figure 3:
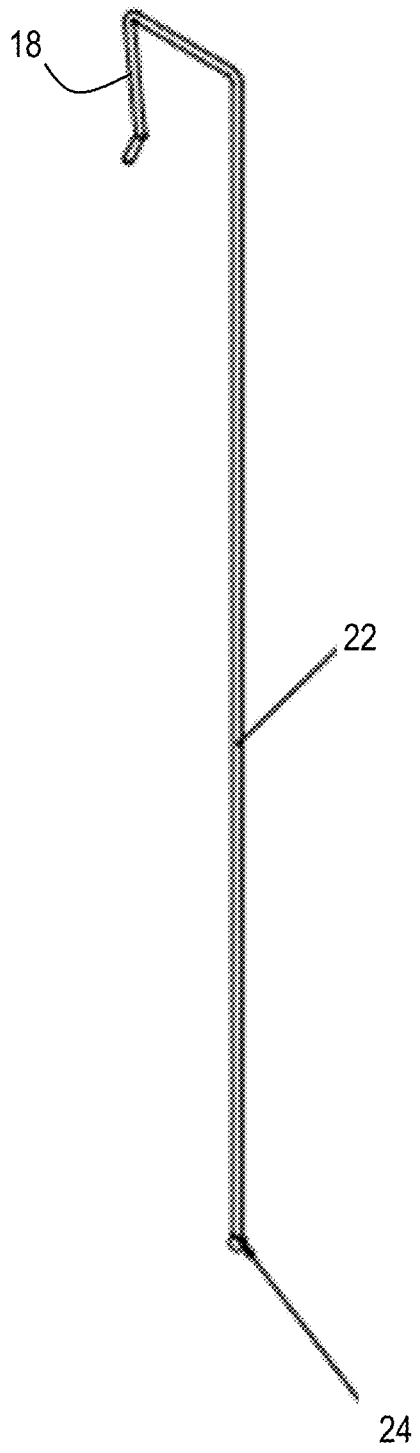
FIG. 3 is perspective view of a single hanger for an over the door hanging assembly according to the present invention.
Figure 4:
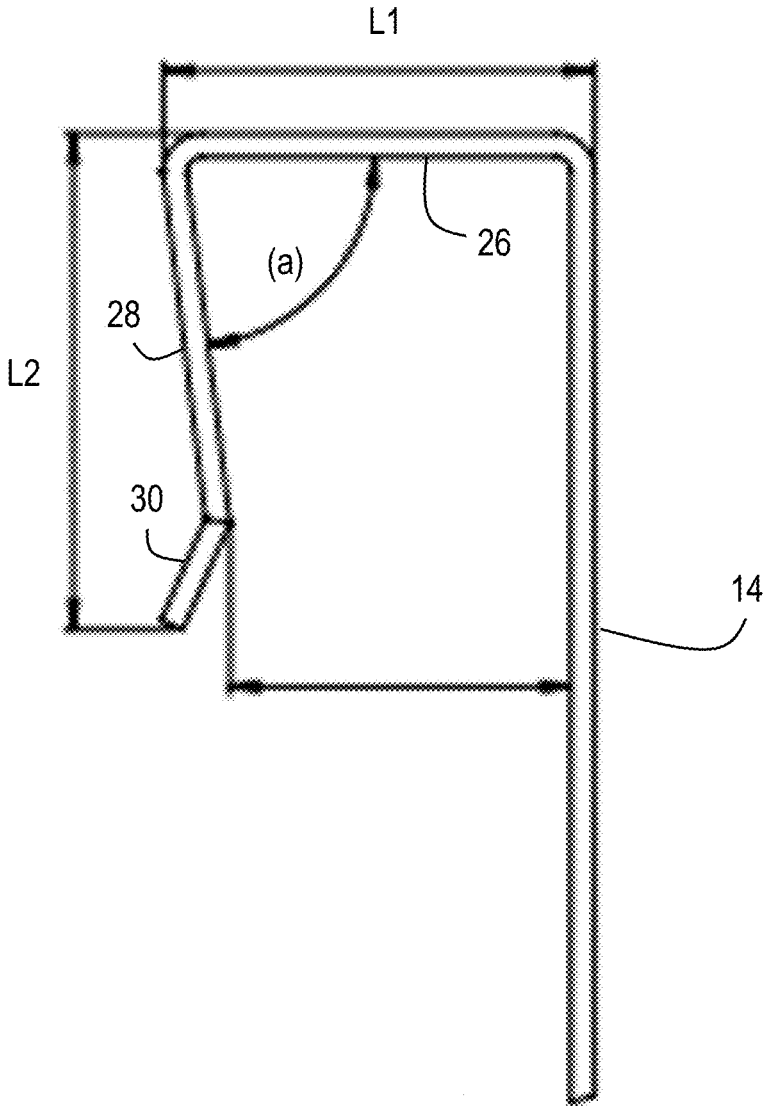
FIG. 4 is a side view of a single hanger for an over the door hanging assembly according to the present invention.

Referring to FIG. 3, each hanger 14 includes a shaft 22 extending from a ball 24 to hook 18. Hanger 14 is preferably formed from 2.7 mm round wire and ball 24 formed from a sphere having a 5 mm diameter. As seen in FIG. 4, hook 18 may be formed by a first leg 26 that extends perpendicularly to shaft 20, a second leg 28 that extending from first leg 26 at a non-perpendicular angle (a) toward shaft 22, and a third leg 30 extending from second leg 28 outwardly away from shaft 22. Angle (a) is preferably about 84 degrees. First leg 26 has a length L1 of preferably about 49 mm and the total length L2 of second leg 28 and third leg 30 is preferably about 57 mm. Shaft 22 may have a length of about 439 mm.

Figure 5:
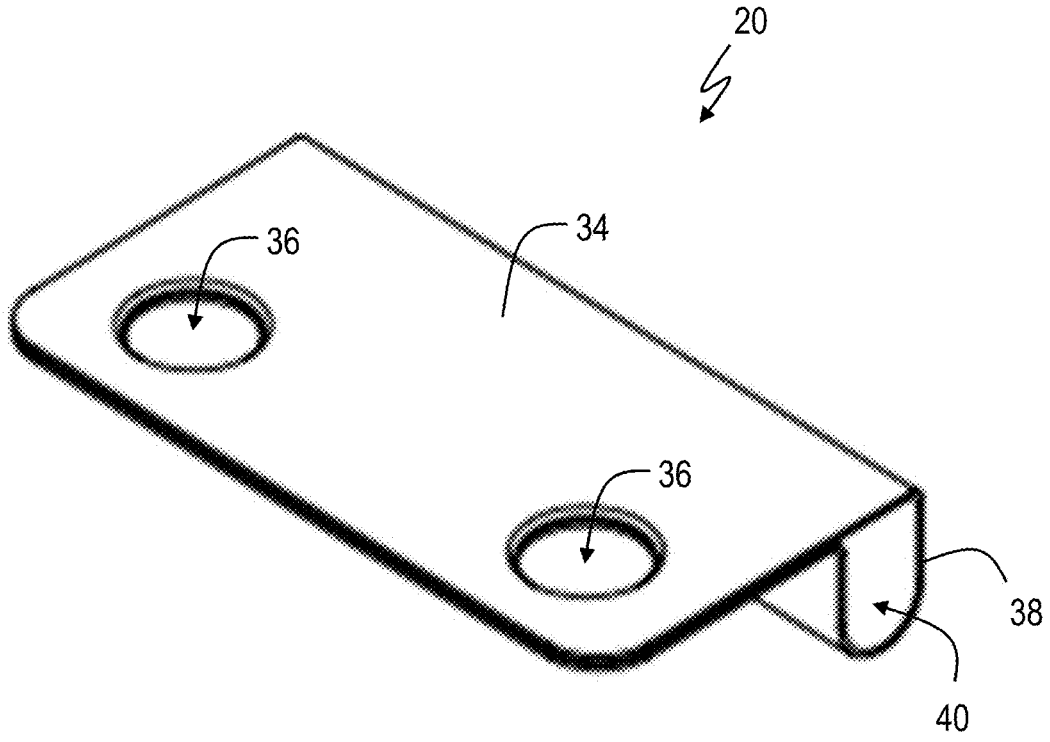
FIG. 5 is a perspective view of a mounting bracket for an over the door hanging assembly according to the present invention.

Referring to FIG. 5, each mounting bracket 20 comprises a planar member 34 having a pair of openings 36 formed therethrough and positioned along one side of member 34. Mounting bracket 20 further includes a tubular channel 38 extending along the opposing side of mounting bracket 20 from opening 36. Tubular channel 38 defines a passageway 40 that is dimensioned to accept shaft 22 but not ball 24. Mounting bracket 20 may be formed from a single piece of folded material similar to a P-clip to allow for easy insertion of hanger 14 into bracket 20 prior to securing bracket 20 to object 10.

Figure 6:
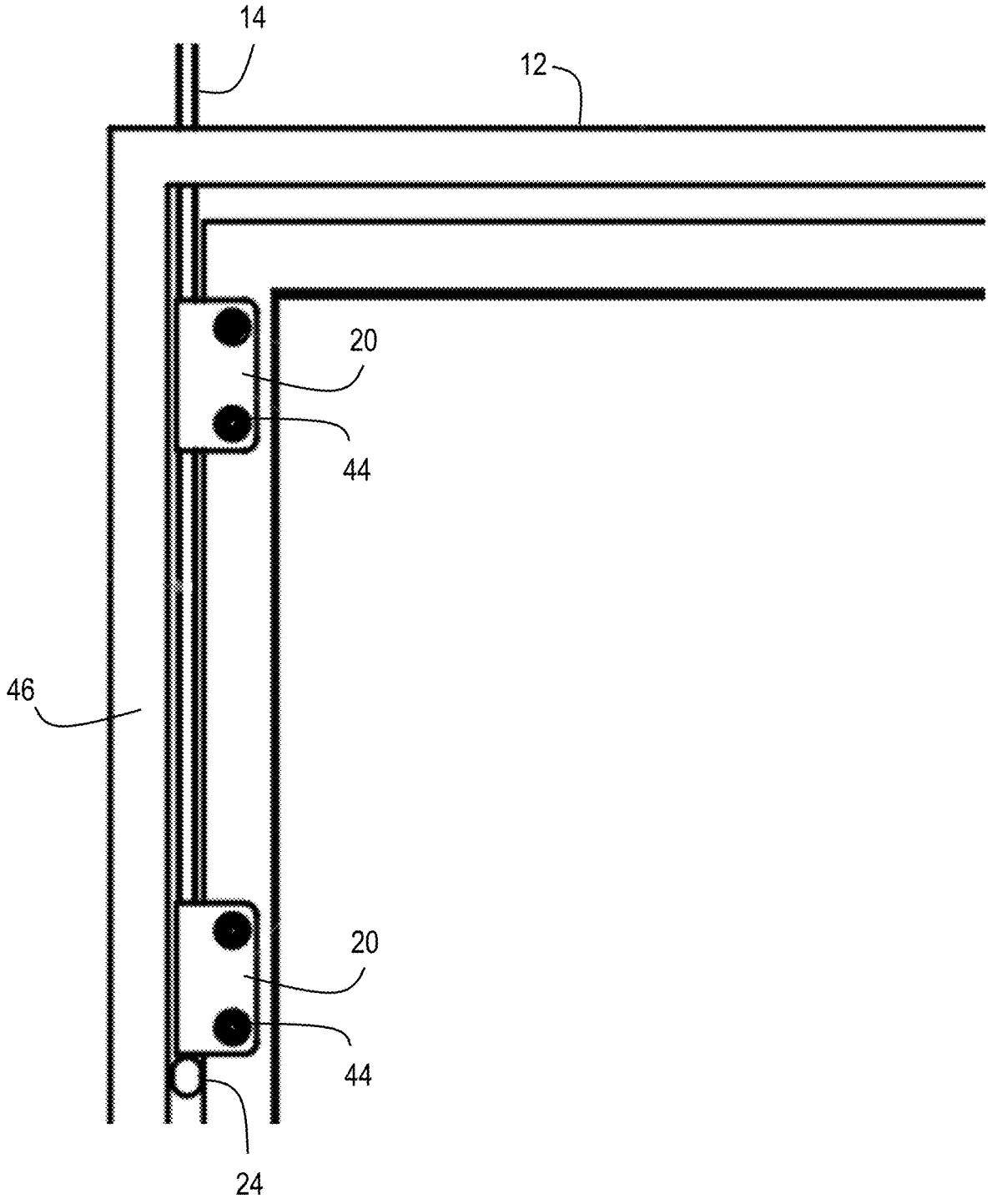
FIG. 6 is a rear view of an object including an over the door hanging assembly according to the present invention.

Referring to FIG. 6, over the door hanging assembly 10 can be installed onto object 12 by securing a pair of mounting brackets 20 to one vertical side of object 12, such as by positioning screws 44 through opening 36 and into a frame 46 of object 12, so that shaft 12 extends vertically through passageway 40 of each mounting bracket 20. Hanger 14 is free to slide within mounting brackets 20 between the retracted and extended positions, with ball 24 providing a stop at the lower mounting bracket 20 and thus defining the extent to which hanger 14 may be extended and also providing a bearing surface for the weight of object 12 when over the door hanging assembly 10 is used to hang object 12 on a door. It should be recognized that the coupling of shaft 22 to mounting bracket 20 by channel 38 also allows for rotation of hanger 14 about the longitudinal axis of shaft 22, thereby allowing hook 14 to be easily stowed behind object 12 or more easily positioned to accommodate different doors.

It should be recognized by those of skill in the art that a product made according to present design may be fully assembled at the time of manufacture with hangers 14 provided in the stowed position. The product may then be easily packaged, shipped, etc. with hangers 14 ready for use. An end user thus only needs to extend hangers 14 to suspend the product with hangers 14 positioned over a door. Alternatively, hangers 14 may be left in the stowed position where hangers 14 are out of view so that the product can be used on other locations, including mounting flush against a wall or door without use of hangers 14. A product made according to the present invention thus has no loose parts and does not require any further assembly by an end user.

What is claimed is:

1. An over the door hanging apparatus, comprising:

a frame having a pair of sides and an upper edge extending between the sides to define a front vertical surface and a rear vertical surface of the frame;

a mirror coupled to the frame;

a pair of hangers, wherein each hanger is mounted to one of the pair of sides on the rear vertical surface of the frame and includes a shaft extending along a longitudinal axis from a ball to a hook formed by a first leg that extends perpendicularly from the shaft and a second leg that extends obliquely to the first leg and is spaced apart from the shaft to accommodate to a door therebetween; and a set of mounting brackets coupled to the rear vertical surface of the frame, wherein each bracket includes a channel having a passageway dimensioned to accept the shaft but not the ball of each hanger, wherein the shaft of each of the pair of hangers extends through the passageway of the channel of one of the set of mounting brackets and is free to slide through the passageway along the longitudinal axis along the rear vertical surface of the frame so that the shaft of each of the pair of hangers is moveable between a retracted position, where the ball is not engaged with the channel and the hook of each of the pair of hangers is positioned below the upper edge of the frame and flush against the rear vertical side of the frame, and an extended position, where the hook is spaced apart from the bracket by the shaft and the ball is engaged with the channel so that the hook extends above the upper edge of the frame and can engage the door with the door being accommodated between the second leg of the hook and the shaft and first leg of the hook in engagement with a top of the door.

2. The apparatus of claim 1, wherein the set of mounting brackets includes two mounting brackets associated with each of the pair of hangers.

3. The apparatus of claim 1, wherein the hangers are free to rotate about a longitudinal axis of the shaft of the hooks.

4. A method of suspending a mirror from a door, comprising the steps of:

providing an over the door hanging apparatus having, a pair of hangers, wherein each hanger includes a shaft extending from a ball to a hook formed by a first leg that extends perpendicularly from the shaft and a second leg that extends obliquely to the first leg and is spaced apart from the shaft to accommodate to a door therebetween, and a set of mounting brackets, wherein each bracket includes a channel having a passageway dimensioned to accept the shaft but not the ball of each hanger;

coupling the over the door hanging apparatus to a frame with a pair of sides and an upper edge extending between the sides to define a front vertical surface and a rear vertical surface and having a mirror coupled to the frame by securing the set of mounting brackets to the rear vertical surface of the frame with the shafts of the hangers extending through the channels of the mounting brackets;

sliding the shaft of each of the hangers through the passageway along a longitudinal axis of the shaft to move each of the pair of hangers from a retracted position, where the ball is not engaged with the channel and the hook of each of the pair of hangers is positioned below the upper edge of the frame and flush against the rear vertical side of the frame, to an extended position, where the hook is spaced apart from the bracket by the shaft and the ball is engaged with the channel so that the hook extends above the upper edge of the frame; and positioning the hooks over a top of the door so that the first leg of the hook engages the top of the door with the door being accommodated between the second leg of the hook and the shaft so that the mirror is suspended from the door.

5. The method of claim 4, wherein the set of mounting brackets includes two mounting brackets associated with each of the pair of hangers.

6. The method of claim 5, wherein the mounting brackets are secured to the frame by screws.

7. The method of claim 6, wherein the ball of each of the hangers is in connect with one channel of one mounting bracket when the hangers are in the extended position.

8. The apparatus of claim 7, wherein the hangers are free to rotate about a longitudinal axis of the shaft of the hooks.

* * * * *